US006009918A

United States Patent [19]

Beyaert

[11] Patent Number: 6,009,918

[45] Date of Patent: Jan. 4, 2000

[54] POWER LOOM

[75] Inventor: Daniel Beyaert, Loker-Heuvelland, Belgium

[73] Assignee: Picanol N.V., Ypres, Belgium

[21] Appl. No.: 09/101,300

[22] PCT Filed: Jan. 16, 1997

[86] PCT No.: PCT/EP97/00178

§ 371 Date: Mar. 18, 1999

§ 102(e) Date: Mar. 18, 1999

[87] PCT Pub. No.: WO97/26396

PCT Pub. Date: Jul. 24, 1997

[30] Foreign Application Priority Data

Jan. 19, 1996 [BE] Belgium ..... 9600049

[51] Int. Cl.[7] ..... D03C 9/06

[52] U.S. Cl. ..... 139/92

[58] Field of Search ..... 139/92

[56] References Cited

U.S. PATENT DOCUMENTS 3,895,655 7/1975 Sujdak ..... 139/92
4,106,530 8/1978 Kaufmann ..... 139/92

FOREIGN PATENT DOCUMENTS 94 13 705 12/1994 Germany .
31734 8/1933 Netherlands .

*Primary Examiner*—Andy Falik
*Attorney, Agent, or Firm*—Bacon & Thomas PLLC

[57] ABSTRACT

A power loom harness fitted with an upper and a lower cross-sectional contoured rail is arranged to support heddles by extending through eyes at the ends of the heddles. An inset is combined with a first of the rails in order to reduce play, in the direction of motion of the harness, between drive surfaces of the first rail and corresponding mating surfaces of the heddle eyes, so that play between the first rail and corresponding heddle eyes is less than play between the second of the two rails and corresponding heddle eyes, so that the first rail drives the heddle in two directions and the second rails serves a guiding function.

12 Claims, 6 Drawing Sheets

POWER LOOM

BACKGROUND OF THE INVENTION

1. Field of the Invention

The invention relates to a power-loom harness fitted with an upper and lower, sectionally contoured, rail, for instance a bar rail, hereafter called "rail", the heddles being held to the rails by means of eyes in their ends.

2. Description of the Related Art

Several harnesses of the initially cited kind form a so-called harness system. The individual harnesses of this system are alternately raised and lowered by means of a harness machine in accordance with predetermined patterns in order that sheds shall be formed from warp yarns guided by the heddles, a filling yarn being transported into the sheds. Conventionally the heddle eyes and the rails are so structured that, for one direction of motion of the harness, one of the rails rests by a drive surface against a mating heddle eye and drives these heddles. As regards the other direction of motion, the other rail by means of a drive surface drives a mating surface of the heddle eyes associated with it. Because the heddles and also the harness expand thermally and both are subject to certain manufacturing tolerances, and because the heddles must furthermore be displaceable along the rails, for instance to allow insertion or repair of the warps, the heddles are provided with a play of on the order of 2 to 3 mm between the drive surface of one rail and the drive surface of the other rail.

When the harness is in the raised position, the heddles, that is their eyes, make contact with the drive surface of the upper rail. If thereupon the harness is lowered, the heddles disengage, due to tension in the warps and inertia, at a given time, from the drive surface of the upper rail and thereafter make contact with the drive surface of the lower rail. Similarly, the heddles disengage, at a given time during the upward motion of the harness, from the drive surface of the lower rail and thereafter make contact with the drive surface of the upper rail. The disengagement of the heddles from one rail and their subsequent application against the other rail following a free displacement in the direction of motion of the harness over a path of 2–3 mm causes impacts which entail noise on one hand and heddle vibration on the other hand. Especially at high speeds and in the long term, these impacts and the vibrations so incurred may cause rupture of the heddles and/or of the harnesses.

It is known from the German patent document U 94 13 705.6 to use only one rail as the drive rail to drive the heddles both during the raising and the lowering of the harness, so that the play may be reduced and the magnitude of the impacts may be lessened. In the known design, the rail acting as the drive rail is accordingly fitted with a thin, transverse leg that enters, with little play, a drive slot of the associated eye of the heddles.

SUMMARY OF THE INVENTION

The objective of the present invention is to improve a harness of the type including bar rails to hold heddles by means of eyes situated at ends of the heddles so that the magnitude of the impacts occurring during weaving shall be reduced.

This problem is solved by associating one or more insets with one of the rails and filling the gap between the drive surfaces of this rail as seen in the direction of motion on one hand and on the other hand the mating surfaces of the heddle eyes in the direction of motion of the harness to such an extent that the play shall be less than between the other rail and the heddle eyes pertaining to this latter rail.

The play in the harness' direction of motion between one of the rails and the associated eyes is reduced so much by means of the one or more insets that the one of the rails drives the heddles both during the raising and lowering of the harnesses, that is, the rail acts as a drive rail similarly to the case of the German patent document 94 13 705.6, while the other rail merely guides the heddles. As a result, play can be substantially reduced, for instance to less than 1 mm, and the magnitudes of the generated impacts substantially decreased.

In a further embodiment of the invention, the one or more insets are made of plastic. Thereby the generated noise may be reduced further, the inset or insets also providing damping in at least one of the directions of displacement of the harness.

In a first embodiment of the invention, the insets are mounted to the heddles. Illustratively these insets may be inserted in straddling manner in the heddle eyes.

In another embodiment of the invention, at least one strip-shaped inset is provided which runs essentially over the full length of the associated rail. Such a strip-inset is easy to assemble. Illustratively, after mounting the heddles, the one strip-shaped inset may be slipped into the heddle eyes.

In a further embodiment, the inset is a tubular element which can be expanded by a controlled supply of a pressurized medium. Due to the supply of the pressurized medium, the tubular element can be expanded to such an extent that the play between the heddles and the driving rail is in practice eliminated. If, however, the pressurized medium is exhausted from this tubular element, the element will contract so much that the heddles can easily be shifted on the rail.

Further features and advantages of the invention are elucidated in the following description of the illustrative embodiments shown in the drawings.

DETAILED DESCRIPTION OF THE PREFERRED EMBODIMENTS

Figure 1:
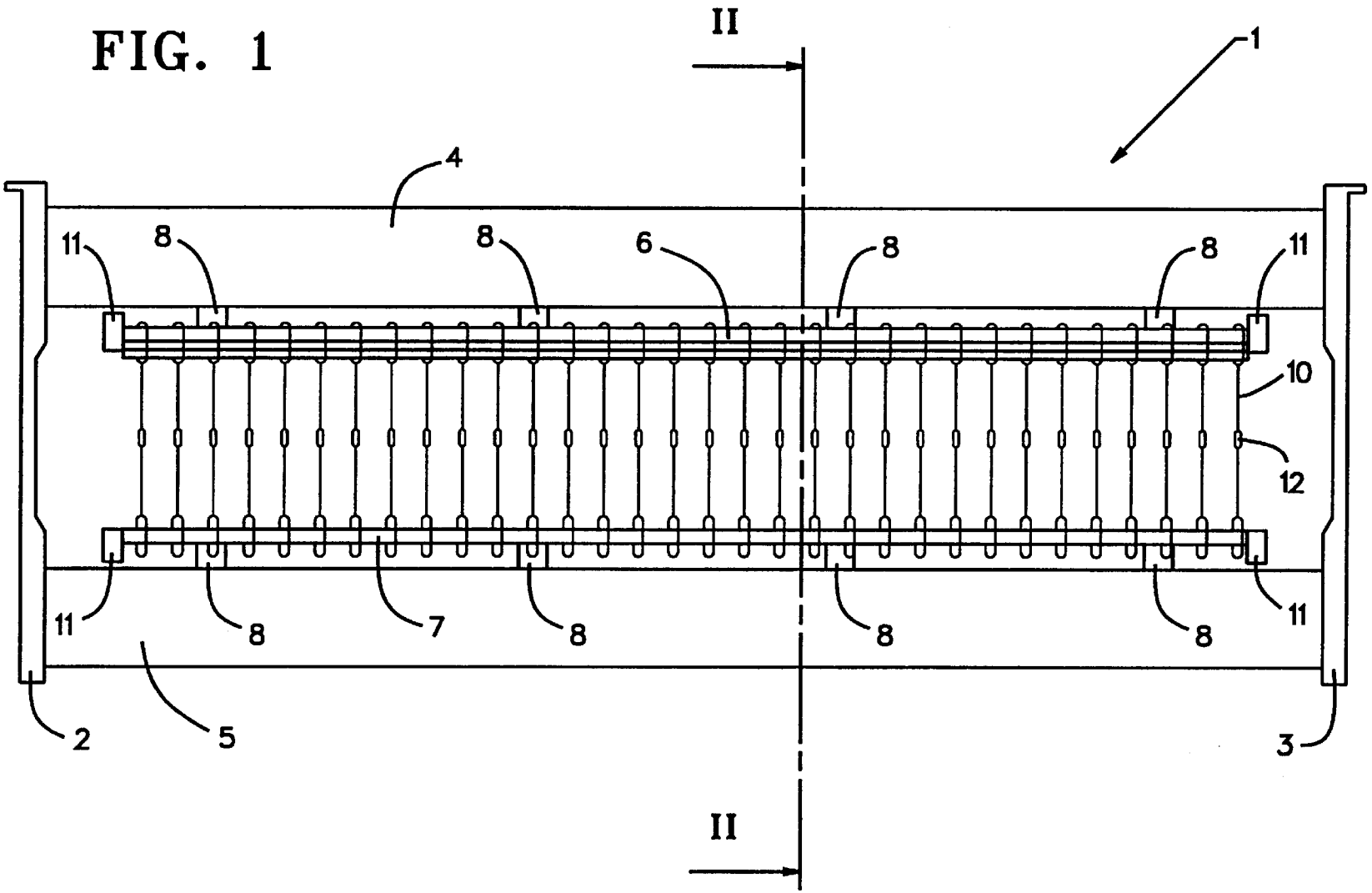
FIG. 1 is a schematic elevation of a harness of the invention.

The harness 1 shown schematically in FIG. 1 includes two side struts 2, 3 connected by cross-braces 4 and 5. A rail 6, 7 is affixed by fasteners 8 and screws 9 (also see FIGS. 10, 11) at predetermined spacings at each cross-brace 4, 5. Heddles 10 are mounted between the rails 6 and 7. Detachable collar elements 11 are present at the side edges of the rails 6 and 7 and prevent the heddles from slipping off the rails 6, 7. The heddles 10 include thread-eyes 12 to guide the warps (not shown).

Figure 2:
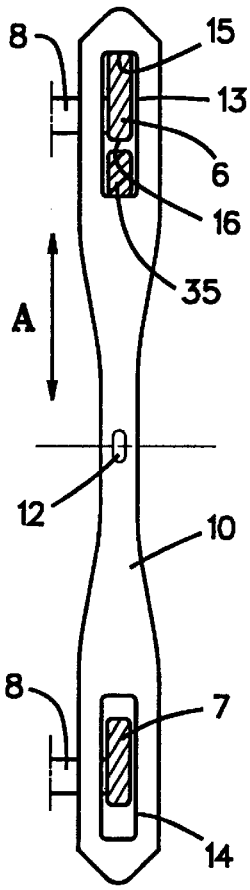
FIGS. 2, 3 are partial sections along the line II—II of FIG. 1 for different drive positions of the harness.
Figure 3:
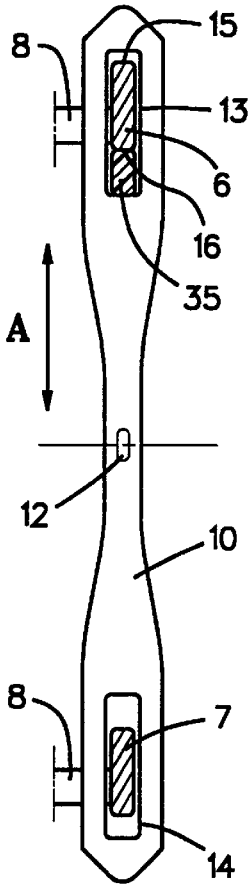

As shown in FIGS. 2 and 3, the heddles 10, which are made of stamped sheetmetal, include eyes 13, 14 in the area of their two ends, each eye enclosing one rail 6, 7. In this embodiment the sizes of the eyes 13, 14 are equal. However, as elucidated below, the design is such that only the upper rail 6 drives the heddles 10 when the harness 1 moves up or down in the direction of arrow A, namely in the longitudinal direction of the heddles 10.

The upper rail 6 includes an upper drive surface 15 associated with a mating surface of the eyes 13 of the heddles 10. The rail 6 furthermore includes a lower drive surface 16 which is also associated with a mating surface of the eyes 13 of the heddles 10. A strip-shaped inset 35 is mounted between the lower drive surface 16 and its associated mating surface of the eyes 13 of the heddles 10 and determines the play by which the heddles 10 may shift relative to the upper rail 6 during the up and down motions of the harness. The strip inset 35 runs over substantially the full length of the rail 6 and preferably is made of plastic, for instance a polyamide. The strip inset 35 limits the possible play to 1 mm or less. Because a lateral play also is present in the eyes 13 relative to the rail 6 and further relative to the strip inset 35, the heddles 10 are very easily shifted on the rail 6. A play is present between the top sides and the bottom sides of the lower rail 7 and the eye 14, and this latter play is substantially larger than that between the upper rail 6 and the strip 35 relative to the eyes 13. Preferably the play between the rail 7 and the eye 14 in the direction of the harness-motion A (the longitudinal direction of the heddles 10), is at least twice the play in the zone of the upper rail 6, which may not only be less than 1 mm, but also may be on the order of 0.5 mm or even less.

In its position shown in FIG. 2, the drive surface 15 makes contact with the associated mating surface of the eyes 13 of the heddles 10. The play occurs between the lower drive surface 16 of the rail 6 and the strip 35 which is inserted only loosely, that is, it is affixed neither to the heddles 10 nor to the rail 6. In the position shown in FIG. 3, it is the lower drive surface 16 of the rail 6 which makes contact with the strip inset 35 which in turn makes contact with the mating surface of the eye 13 of the heddle 10. In this position the play arises between the upper drive surface 15 and the associated mating surface of the eye 13.

In a variation of this embodiment, the strip inset is inserted between the rail 7 and the eyes 14 of the heddles 10 so that the rail acts as the drive element driving the heddles 10 in the direction of motion A while the contour rail 6 only guides the heddles 10.

Figure 10:
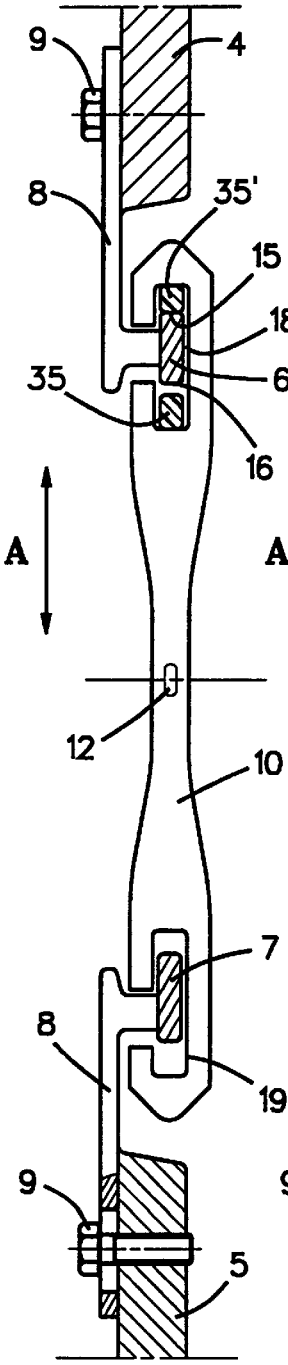
Figure 11:
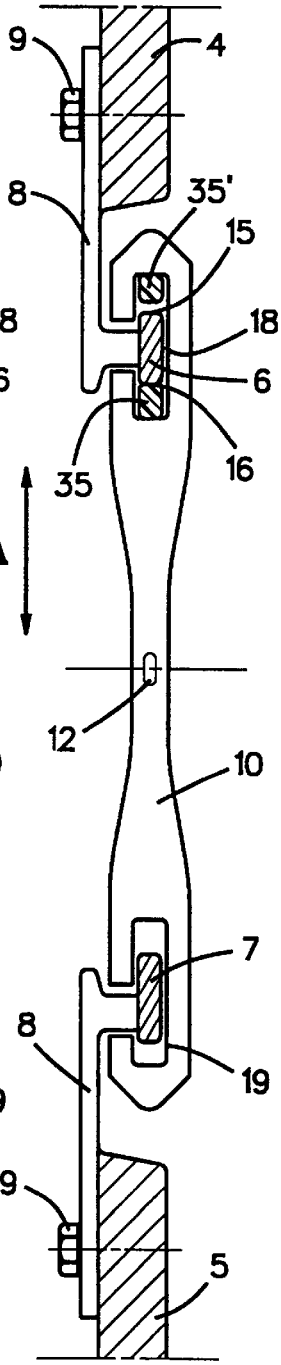

In another variation similar to the embodiment of FIGS. 2 and 3, shown in FIGS. 10 and 11, the heddles 10 include open eyes 18, 19. In this variation, insets 35, 35' are inserted between the upper drive surface 15 of the rail 6 and the lower drive surface 16 of the rail 6 on the one hand and the mating surfaces of eyes 18 on the other hand. The strip insets 35, 35' also are loosely inserted in the embodiments of FIGS. 10 and 11. However in another variation, the strip insets 35 or 35' are affixed to the rail, for instance by adhesive. Obviously, the embodiment variation of FIGS. 10 and 11 may also be modified in such a manner that the strip insets 35 and 35' are associated with the rail 7, which then acts as a drive element driving the heddles 10 during the up-and-down motion of the harness 1, the rail 6 in this case acting only as a guide.

Figure 4:
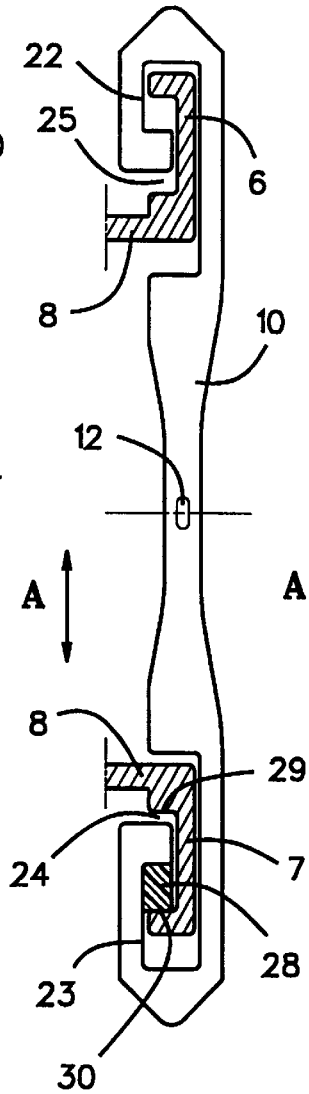
FIGS. 4–13 are sections of further illustrative embodiments similar to those along line II—II of FIG. 1, shown in pairs.
Figure 5:
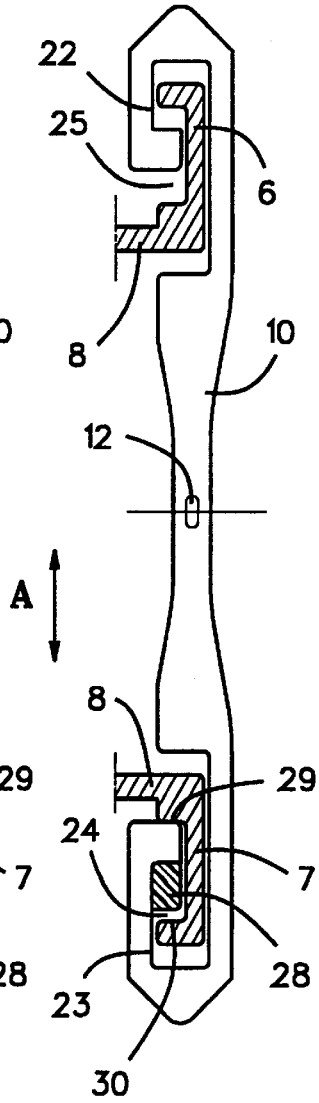

In the embodiment shown in FIGS. 4 and 5, the heddles 10 are fitted with hooked, open eyes 22, 23 each including a bend pointing transversely to the harness' direction of motion A and entering channel-like recesses 24, 25 of the cross-sectionally contoured rails 6, 7. In this embodiment the lower rail 7 is a heddle drive-element and includes an effective drive surface 30 during its lifting motion and an effective drive surface 29 during its lowering motion, the effective drive surfaces being associated with mating surfaces of the bend of the eye 23 that enters the recess 24. A preferably plastic inset 28 is present between the drive surface 30 and the mating surface of the hooked eye 23 to limit the play in the direction A and by which play the heddles 10 can move relative to the rail 7. Individual insets 28 may be provided that are affixed to the heddles 10. Preferably however a strip inset 28 is used that runs at least approximately over the full length of the rail 7 and that is loosely inserted. The structures of the two rails 6, 7 are the same and they are mounted in mirror-symmetrical manner. Because the bend entering the recess 25 is without function in this embodiment, this bend also may be omitted in the region of this eye 22.

Figure 6:
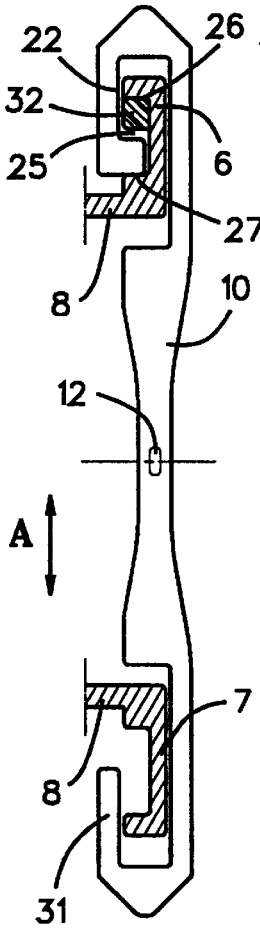
Figure 7:
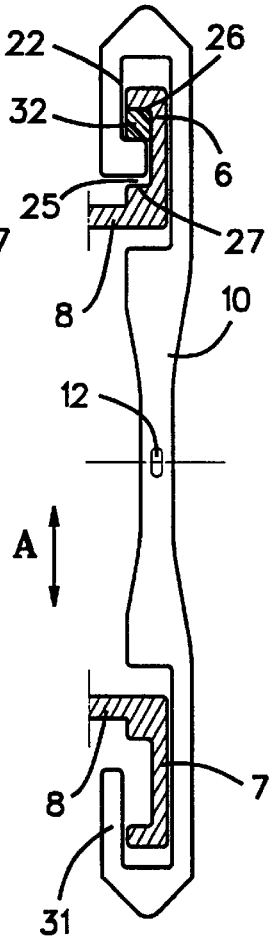

The embodiment of FIGS. 6 and 7 is basically that of FIGS. 4 and 5, but now the upper rail 6 is the drive element and the lower rail 7 merely serves as a guide. The eye 31 associated with the lower rail 7 therefore may be simplified, that is, the bend entering the recess of the lower rail 7 can be eliminated. In this case the recess 25 of the rail 6 constitutes two drive surfaces 26, 27 associated with the bend entering the recess 25 of the hooked eye 22. A substantially strip-shaped inset 32 is inserted into the recess 25 and runs substantially over the full length of the rail 6. This strip inset 32 determines the play by which the heddles 10 can move in the direction A. The strip inset 32 also preferably is made of plastic and can be affixed in the position shown in FIG. 6 to the rail 6 by, for instance, an adhesive. In practice, however, it is enough to merely loosely insert the inset 32, that is to bond it neither to the rail 6 nor to the heddles 10.

Figure 8:
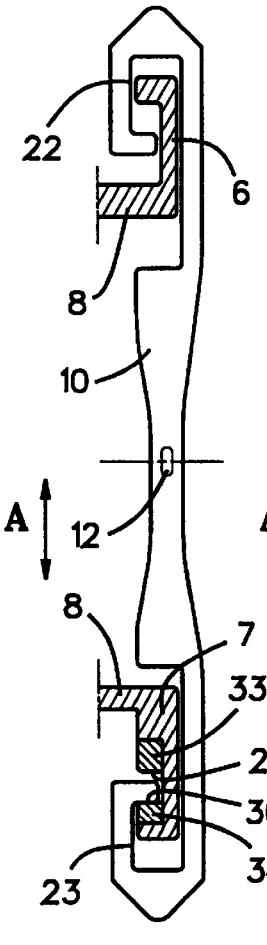
Figure 9:
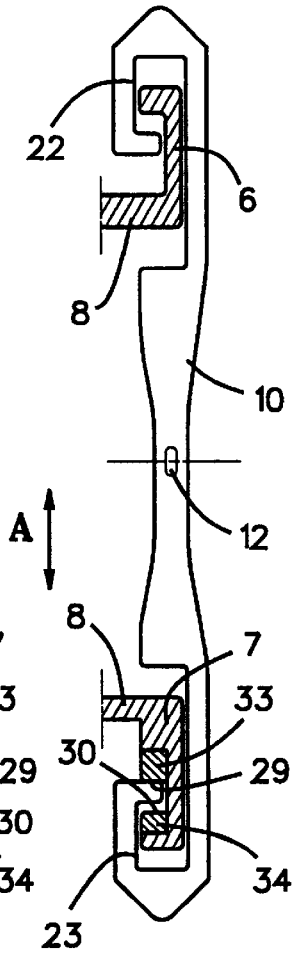

The heddles 10 fitted with hooked open eyes 22, 23 shown in the embodiment of FIGS. 8 and 9 are again associated with the lower rail 7 in such a manner that the rail acts as a drive element to drive the heddles 10 in the direction of the arrow A. Two preferably plastic insets 33, 34 are inserted into the longitudinal recess of the rail 7 and essentially run over the full length of the rail 7. These strip insets 33, 34 constitute drive surfaces 29, 30 associated with the bend of the hooked eye 23 entering the recess of the rail 7.

Figure 12:
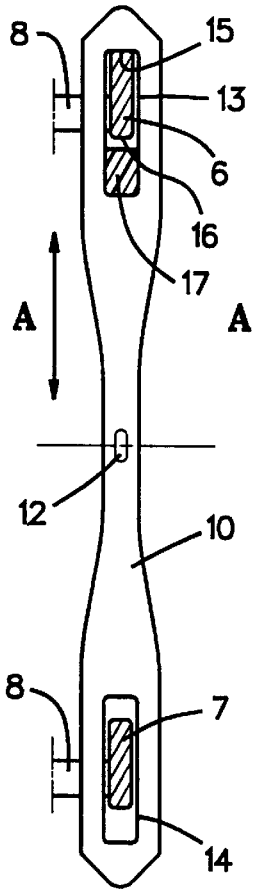
Figure 13:
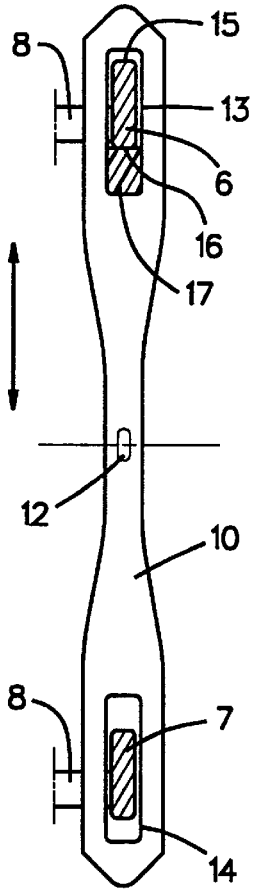

Insets 17 are inserted in the embodiment of FIGS. 12 and 13 between the lower drive surface 16 of the upper rail 6 and the mating surfaces of the eyes 13 of the heddles 10, and accordingly this embodiment operates in the manner of that of FIGS. 2 and 3. In this embodiment, however, the insets 17 are individual plastic elements inserted into the eyes 13 of the heddles 10 and affixed to them.

Figure 14:
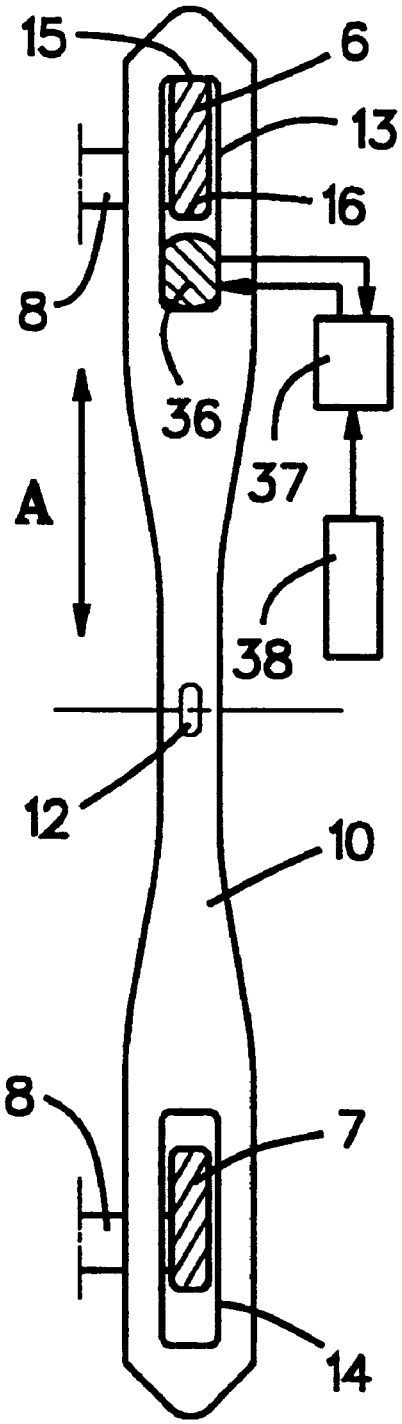
FIGS. 14, 15 are sections similar to those of FIGS. 2 and 3 of an illustrative embodiment of the invention including an inset expandable by a pressurized medium.
Figure 15:
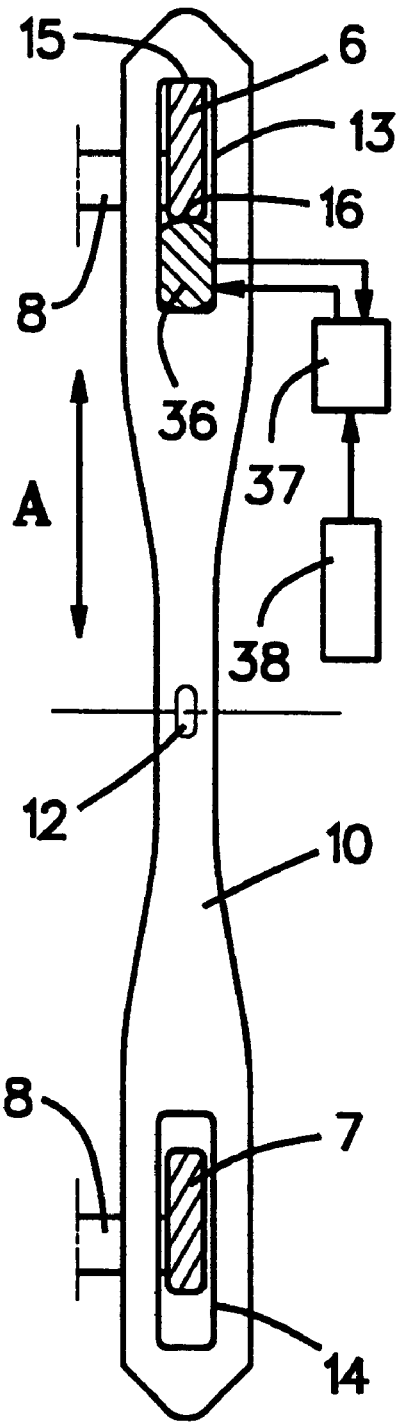
Figure 16:
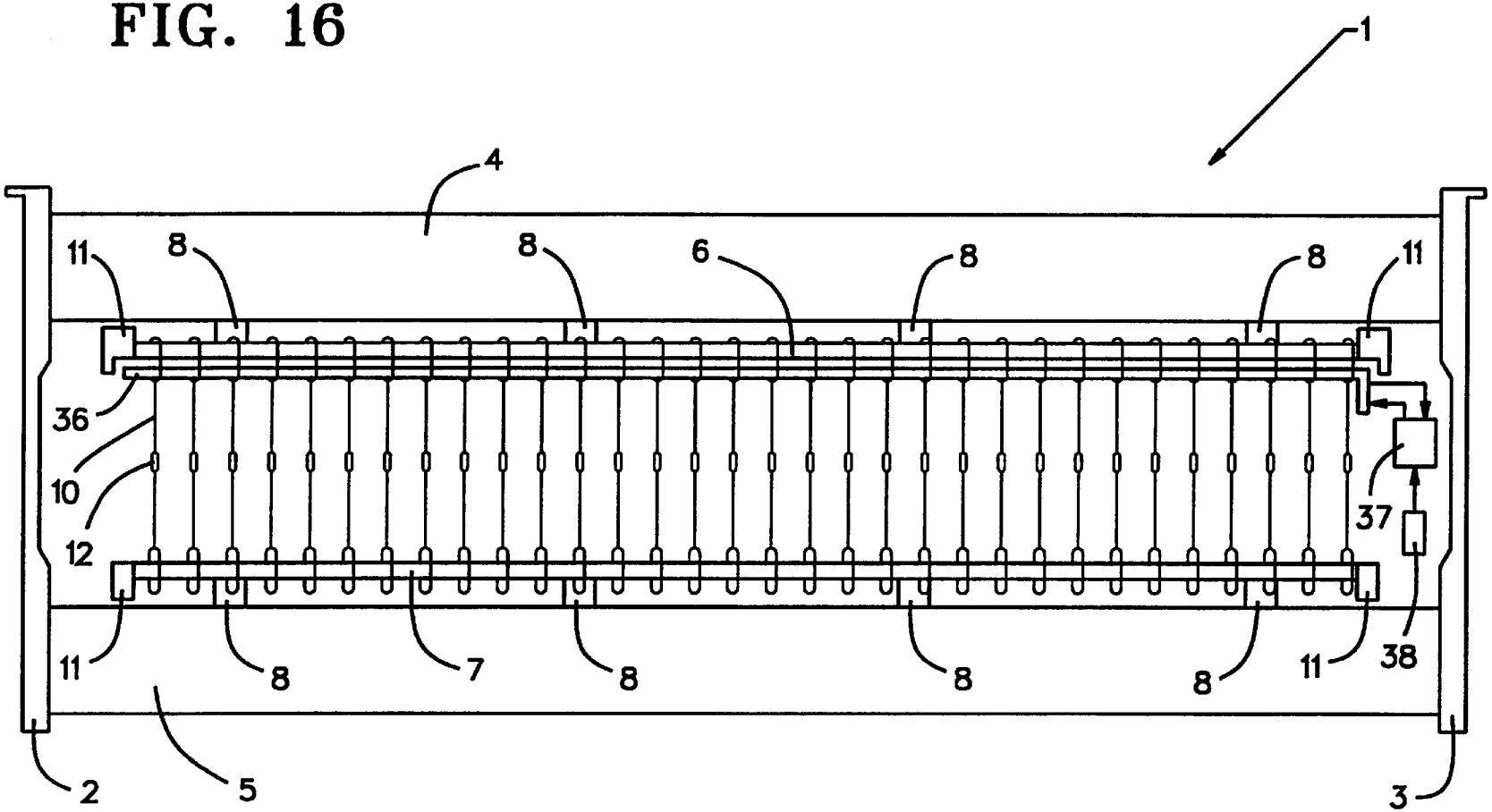
FIG. 16 is an elevation of a harness corresponding to the illustrative embodiment of FIGS. 14 and 15.

FIGS. 14 and 15 show an illustrative embodiment of the invention wherein a tubular element acting as an inset 36 is mounted between a lower drive surface 16 of the rail 6 and a mating surface of the eye 13 of the heddles 10. This inset 36 can implement a contact with the lower drive surface 16 of the rail 6 and direct contact between the upper drive surface 15 and the eye 13. On the other hand, the heddles 10 in the vicinity of the eyes 14 do not make contact with the lower rail in the direction of motion denoted by the arrow A. A pressurized medium is fed into the inset 36 which thereby expands and provides play-less connection between the rail 6 and the heddles 10. The inset 36 is connected to a controlled device 37, for instance a pump for supplying and evacuating the pressurized medium. Illustratively, the medium is water supplied or evacuated by a pump 37. The device is controlled by a control unit 38. The inset 36 runs over the full length of the rail 6 and thereby reliably cooperates with all heddles (FIG. 16). Consequently the inset 36 is at least as long as the zone of the rail holding the heddles 10. In a variation of this embodiment the inset 36 receives compressed air as the pressurized medium. In this instance, the device 37 is a valve unit by which to connect the inset 36 to a source of compressed air.

When a pressurized medium is fed into the tubular inset 36, the latter constrains the heddles 10 to come into direct contact with the upper drive surface 15 of the rail 6 while simultaneously itself setting up contact between the lower drive surface 16 of the rail 6 and the heddles 10. Thereby the heddles 10 are held in play-less manner at the rail 6 and free displacement of the heddles 10 in their lengthwise direction A relative to the rail 6 is precluded. Impacts, vibrations and noise are averted in this manner.

When the pressurized medium is evacuated from the tubular inset 36, the elastic inset 36 resumes its position shown in FIG. 14 and thereupon the heddles 10 can be displaced along the rail 6 in problem-free manner. This approach may be required for instance when ruptured warps must be fixed.

During weaving the device 37 is so controlled by the control unit 38 that the tubular inset 36 is fed with a pressurized medium and accordingly the heddles 10 will be in the position shown in FIG. 15. If warp rupture is ascertained, and the loom stopped, then the device 37 is so controlled by the control unit 38 that the pressurized medium escapes from the inset 36, whereby the heddles 10 thereafter are in the position shown in FIG. 14. When the power loom is started again, the control unit 38 controls the device 37 in such a manner that following a few seconds the pressurized medium is again fed into the inset 36 and thereby the position shown in FIG. 15 is reached again. As a result, following displacement along the rail 6 to repair a warp rupture, the heddles 10 may resume their pre warp-rupture position, before the heddles 10 are made to contact in play-less manner the rail by means of the inset 36.

The control unit 38 contains means which, depending on the mode of the power loom, that is normal weaving, weaving stoppage upon warp rupture, or resumption of weaving following warp rupture, controls whether or not the device 37 supplies the pressurized medium to the inset 36. The loom's operational mode is determined on the basis of warp-rupture signals or loom-starting signals.

The eyes of the heddles 10 which do not make contact with the associated rail 6 or 7 in the harness' direction of motion A only serve to preclude the heddles 10 from shifting in a direction perpendicular to the longitudinal direction A relative to the particular rail 6 or 7. The eyes of the heddles 10 which implement contact with the drive surfaces of one of the rails 6 or 7 in the harness' direction of displacement A obviously also serve to prevent the heddles 10 from moving in a direction perpendicular to their longitudinal direction A relative to the associated rail 6 or 7. By preventing a motion perpendicular to the longitudinal direction A of the heddles, these heddles 10 simultaneously are safe from being bent.

Using a wear-resistant plastic for the particular insets or for the strip-like continuous insets also is advantageous regarding noise.

Whether the heddles 10 are driven by the upper rail 6 or the lower rail 7 depends on the selected weave. As regards weaves for which more harnesses 1 are in the lower shed, for instance for a twill weave, or for a one-three or a two-three weave, driving is preferred by the lower rail 7. For weaves with more harnesses in the upper shed, for instance for two-one or three-one or three-two weaves, driving is preferably by the upper rail 6.

The invention is not limited to the shown embodiments. Differently cross-sectionally contoured rails and/or differently shaped eyes may be easily combined, for instance hooked eyes, or open and closed eyes.

I claim:

1. A power loom harness fitted with an upper and a lower rail arranged to hold heddles, the heddles having first eyes at a first end thereof and second eyes at a second end thereof, and the upper and lower rails passing through said eyes at respective ends of the heddles, comprising:

at least one inset associated with a first of said rails, said inset being positioned at least partially within at least one of said first eyes between a drive surface of the first rail and a mating surface of said at least one of said first eyes so as to reduce play between the first rail and the at least one of said first eyes in a direction of motion of the harness, and wherein the play between the first rail and the at least one of said first eyes is less than a play between a second of said rails and a corresponding one of said second eyes.

2. A harness as claimed in claim 1, wherein the first rail is the upper rail.

3. A harness as claimed in claim 1, wherein the first rail is the lower rail.

4. A harness as claimed in claim 1, wherein said at least one inset is constructed of plastic.

5. A harness as claimed in claim 1, wherein said at least one inset is mounted to at least one of the heddles.

6. A harness as claimed in claim 1, wherein said at least one inset is a strip-like inset that extends substantially over a full length of the associated first of said upper and lower rails.

7. A harness as claimed in claim 6, wherein said strip-like inset is displaceable relative to the first rail in the direction of motion of the harness.

8. A harness as claimed in claim 6, wherein said striplike inset is affixed to the first rail.

9. A harness as claimed in claim 6, wherein said strip-like inset is mounted in one of two locations, the two locations being in front of the first rail as seen in the direction of motion of the harness, and the second being behind the first rail as seen in the direction of motion of the harness.

10. A harness as claimed in claim 1, wherein the inset is mounted in a side recess of the first rail, said recess being entered by at least one bent portion of the heddles that forms a second said mating surface.

11. A harness as claimed in claim 10, wherein the recess is fitted with two said insets mounted on two sides of the at least one bent portion of the heddles.

12. A harness as claimed in claim 1, wherein the inset is a tubular element arranged to expand when fed with a pressurized medium and thereby eliminate said play between the first rail and said at least one of said first eyes.

* * * * *